US009772110B2

(12) United States Patent
Liu

(10) Patent No.: US 9,772,110 B2
(45) Date of Patent: Sep. 26, 2017

(54) GAS CONTROL VALVE FEATURING MAGNETIC CONTROL AND GAS IGNITION SYSTEM HAVING THE SAME

(71) Applicant: Hsu-Nan Liu, Taipei (TW)

(72) Inventor: Hsu-Nan Liu, Taipei (TW)

( * ) Notice: Subject to any disclaimer, the term of this patent is extended or adjusted under 35 U.S.C. 154(b) by 413 days.

(21) Appl. No.: 14/519,412

(22) Filed: Oct. 21, 2014

(65) Prior Publication Data

US 2016/0109126 A1 Apr. 21, 2016

(51) Int. Cl.

| | |
|---|---|
| ***F23Q 9/12*** | (2006.01) |
| ***F23N 5/26*** | (2006.01) |
| ***F23Q 9/00*** | (2006.01) |

(52) U.S. Cl.

CPC ..... *F23N 5/265* (2013.01); *F23Q 9/00* (2013.01); *F23N 2027/30* (2013.01); *F23N 2900/05101* (2013.01)

(58) Field of Classification Search

CPC .. F23Q 9/00; F23N 5/265; F23N 2900/05101; F23N 2027/30; F24C 3/103; F24C 3/126

See application file for complete search history.

(56) References Cited

U.S. PATENT DOCUMENTS 4,872,435 A * 10/1989 Ueyama ..... F02D 11/107 123/336

6,568,284 B1 * 5/2003 Reichl ..... G01B 7/30 324/207.2

* cited by examiner

*Primary Examiner* — Alfred Basichas

(74) *Attorney, Agent, or Firm* — Rosenberg, Klein & Lee

(57) ABSTRACT

A gas control valve featuring magnetic control and a gas ignition system having the same are disclosed. The gas control valve includes a main body and a magnetic control assembly. The main body has a valve base and a control lever. The control lever is movably connected to the valve base. The magnetic control assembly has a magnetic member and a magnetic control switch. The magnetic member is installed in one of the valve base and the control lever, while the magnetic control switch is installed in the other of the valve base and the control lever. When the control lever moves to an ignition position, the magnetic control switch is affected by the magnetic member and forms a closed circuit. The magnetic control assembly is incorporated in the gas control valve in a modularized manner, and can be easily maintained and repaired.

17 Claims, 15 Drawing Sheets

GAS CONTROL VALVE FEATURING MAGNETIC CONTROL AND GAS IGNITION SYSTEM HAVING THE SAME

BACKGROUND OF THE INVENTION

1. Technical Field

The present invention relates to gas control valves and systems, and more particularly to a gas control valve that has magnetic control function and is structurally compact, and a gas ignition system having the same.

2. Description of Related Art

Examples of the existing gas switches include U.S. Pat. No. 5,375,585 A titled "Combination of a piezoelectric igniter and a safety valve for a gas range" and U.S. Pat. No. 6,716,025 B1 titled "Gas volume control device for gas burners", both of which use a structural component such as a piezoelectric igniter or a firing pin to perform impact and thereby generate sparks that ignite gas. However, such a mechanism has its problems relating to wearing, noise and loosening. In addition, these known gas switches tend to get degraded by oil sludge accumulated thereon over time.

On the other hand, U.S. Pat. No. 6,446,622 B1 titled "Stove ignition structure" discloses a structure where a magnetic switch is additionally provided in a stove and connected to an igniter, and a magnetic member is provided on the knob of the gas control valve. Thereby, when the knob is rotated, the magnetic member thereon makes the magnetic switch to form a closed circuit that makes the igniter sparkle. However, since the magnetic switch and the magnetic member are disposed separately on the stove, the non-modularized structure of the gas control valve is relatively loose and takes a relatively large space. Also such a complicated structure is unfavorable to product maintenance and repair. Thus, the prior-art devices need to be improved.

SUMMARY OF THE INVENTION

Hence, for effectively integrating magnetic control function into a gas control valve as a structure that is more structurally compact and is more convenient in terms of fabrication, maintenance, repair and replacement, the inventor of present invention has paid great efforts to develop a gas control valve featuring magnetic control. The gas control valve comprises:

a main body, having a valve base and a control lever, wherein the control lever is movably connected to the valve base;

a magnetic control assembly, having a magnetic member and a magnetic control switch, wherein the magnetic member is installed on one of the valve base and the control lever, while the magnetic control switch is installed on the other of the valve base and the control lever, so that when the control lever moves to an ignition position, the magnetic control switch is affected by the magnetic member to form a closed circuit.

Furthermore, the valve base has an axial direction and a transverse direction that is perpendicular to the axial direction, and has an axial hole that extends in the axial direction and such receives the control lever that an operating portion of the control lever is exposed outside the valve base, in which the magnetic control switch is disposed adjacent to the axial hole, while the magnetic member is disposed on the operating portion.

Furthermore, the valve base has a first notch that extends in the transverse direction and a second notch that is connected to the first notch and extends in the axial direction, while the control lever has a first limiting member, so that when the control lever moves in the axial direction, the first limiting member enters the first notch and is at a disengaged position, and then when the control lever rotates, the first limiting member moves along the first notch, so that the first limiting member enters the second notch, and moves to the ignition position along the second notch.

Furthermore, the valve base has at least two stop blocks centering the axial hole and an engaging recess defined between the stop blocks, while the control lever has a second limiting member that is configured to be received in the engaging recess when being at an engaged position, so that when the control lever moves in the axial direction and the first limiting member enters the first notch, the second limiting member leaves the engaging recess so the control lever is at the disengaged position.

Furthermore, the valve base has therein an inlet chamber, a circulation chamber and a gate that is communicated with the inlet chamber and the circulation chamber, and the valve base further has an inlet port and a pilot flame-supply hole, the inlet port being communicated with the inlet chamber, the pilot flame-supply hole being communicated with the circulation chamber. The main body further comprises a closing device configured to be received in the circulation chamber of the valve base, wherein the closing device has a channel therein and a pilot flame orifice. The channel is aligned with the gate, communicated with the pilot flame orifice, and configured to receive the control lever, while the pilot flame orifice corresponds to the pilot flame-supply hole. The closing device further has a sliding slot corresponding to the second limiting member of the control lever, so that when the second limiting member moves along the sliding slot and escapes from the engaging recess, the control lever is at the disengaged position where it can drive the closing device to rotate.

Furthermore, one of the at least two stop blocks has a first extended length in the axial direction, and the other of the at least two stop blocks has a second extended length in the axial direction, in which the second extended length is smaller than the first extended length.

Furthermore, the valve base has therein an inlet chamber, a circulation chamber and a gate that is communicated with the inlet chamber and the circulation chamber, and the valve base further has an inlet port and a pilot flame-supply hole, the inlet port being communicated with the inlet chamber, the pilot flame-supply hole being communicated with the circulation chamber, the valve base having a solenoid valve that is installed in the inlet chamber and has a plug that is configured to removably close the gate, and the control lever having a propping portion that is configured to prop the plug away from the gate so as to allow the inlet port to get communicated with the pilot flame-supply hole.

Furthermore, the solenoid valve is such configured that when receiving a pilot flame ignition signal, the solenoid valve maintains the plug at an open position where the plug is separated from the gate.

Furthermore, the main body further comprises a closing device that is configured to be received in the circulation chamber of the valve base, the closing device having therein a channel that is aligned with the gate, the closing device further having a pilot flame orifice that is communicated with the channel and corresponds to the pilot flame-supply hole. The control lever is inserted through the channel of the closing device.

Furthermore, the valve base has a first main flame-supply hole, and the closing device has a main flame orifice that is communicated with the channel, in which the main flame orifice is configured to be aligned with the first main flame-supply hole in response to rotation of the closing device.

Furthermore, the valve base has a first tube extending from the first main flame-supply hole, and has a second main flame-supply hole that is configured to be aligned with the main flame orifice of the closing device, and the valve base further has a second tube that extends from the second main flame-supply hole and is connected to the first tube, in which the second tube has an adjuster for adjusting a gas flow running through the second tube.

Furthermore, the magnetic control switch is a Hall element.

The present invention also provides a gas ignition system, comprising a gas control valve, a main flame assembly, a pilot flame assembly and an igniter.

The gas control valve has a main body and a magnetic control assembly, wherein the main body has a valve base, a closing device and a control lever. The valve base has therein an inlet chamber, a circulation chamber and a gate communicated with the inlet chamber and the circulation chamber. The valve base also has an inlet port, a pilot flame-supply hole and a main flame-supply hole, in which the inlet port is communicated with the inlet chamber, and the pilot flame-supply hole and the main flame-supply hole are both communicated with the circulation chamber. The valve base has a solenoid valve installed in the inlet chamber and having a plug configured to removably close the gate, so that when receiving a pilot flame ignition signal, the solenoid valve makes the plug stay at an open position where the plug is separated from the gate. The closing device is installed in the circulation chamber of the valve base and has therein a channel aligned with the gate. The closing device further has a pilot flame orifice and a main flame orifice, in which the pilot flame orifice is communicated with the channel and corresponds to the pilot flame-supply hole, while the main flame orifice is communicated with the channel and corresponds to the main flame-supply hole. The control lever is movably connected to the valve base and inserted through the channel of the closing device. The control lever has a propping portion. The magnetic control assembly has a magnetic member and a magnetic control switch, wherein the magnetic member is installed on one of the valve base and the control lever while the magnetic control switch is installed on the other of the valve base and the control lever.

The main flame assembly is connected to the valve base of the gas control valve and has at least one main flame flue communicated with the main flame-supply hole.

The pilot flame assembly is connected to the valve base of the gas control valve and has at least one pilot flame flue communicated with the pilot flame-supply hole.

The igniter is connected to the magnetic control switch of the magnetic control assembly and attached to the pilot flame assembly, wherein when the control lever moves to an ignition position, the propping portion of the control lever props the plug away from the gate, so that the inlet port becomes communicated with the pilot flame-supply hole, and the magnetic control switch is affected by the magnetic member to form a closed circuit that activate the igniter to sparkle.

As compared to the prior-art devices, the present invention at least provide the following advantages:

1. By setting the magnetic member and the magnetic control switch of the magnetic control assembly on the control lever and the valve base of the gas control valve, respectively, the present invention provides an improved integrated magnetic control module. With the modularized design, the resulting structure is more compact, and is convenient to maintain and repair because the components and parts of the gas control valve can be easily replaced.

2. The present invention has the control lever such designed that it can only perform ignition after an initial axial displacement that dismiss engagement, then a rotation and finally an additional axial displacement, so as to prevent users' misoperation.

DETAILED DESCRIPTION OF THE INVENTION

For further illustrating the means and functions by which the present invention achieves the certain objectives, the following description, in conjunction with the accompanying drawings and preferred embodiments, is set forth as below to illustrate the implement, structure, features and effects of the subject matter of the present invention.

Figure 1:
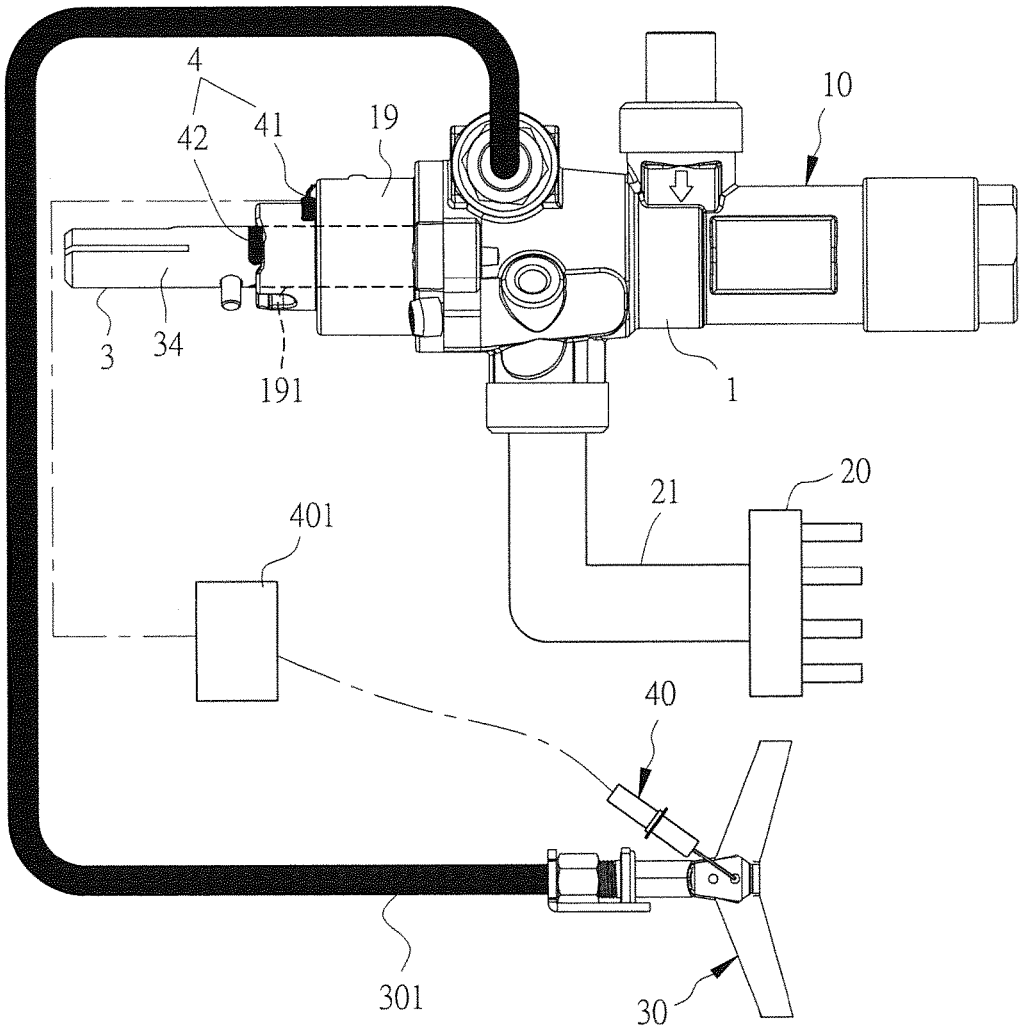
FIG. 1 is a schematic drawing illustrating a gas ignition system having a gas control valve featuring magnetic control according to one embodiment of the present invention.
Figure 2:
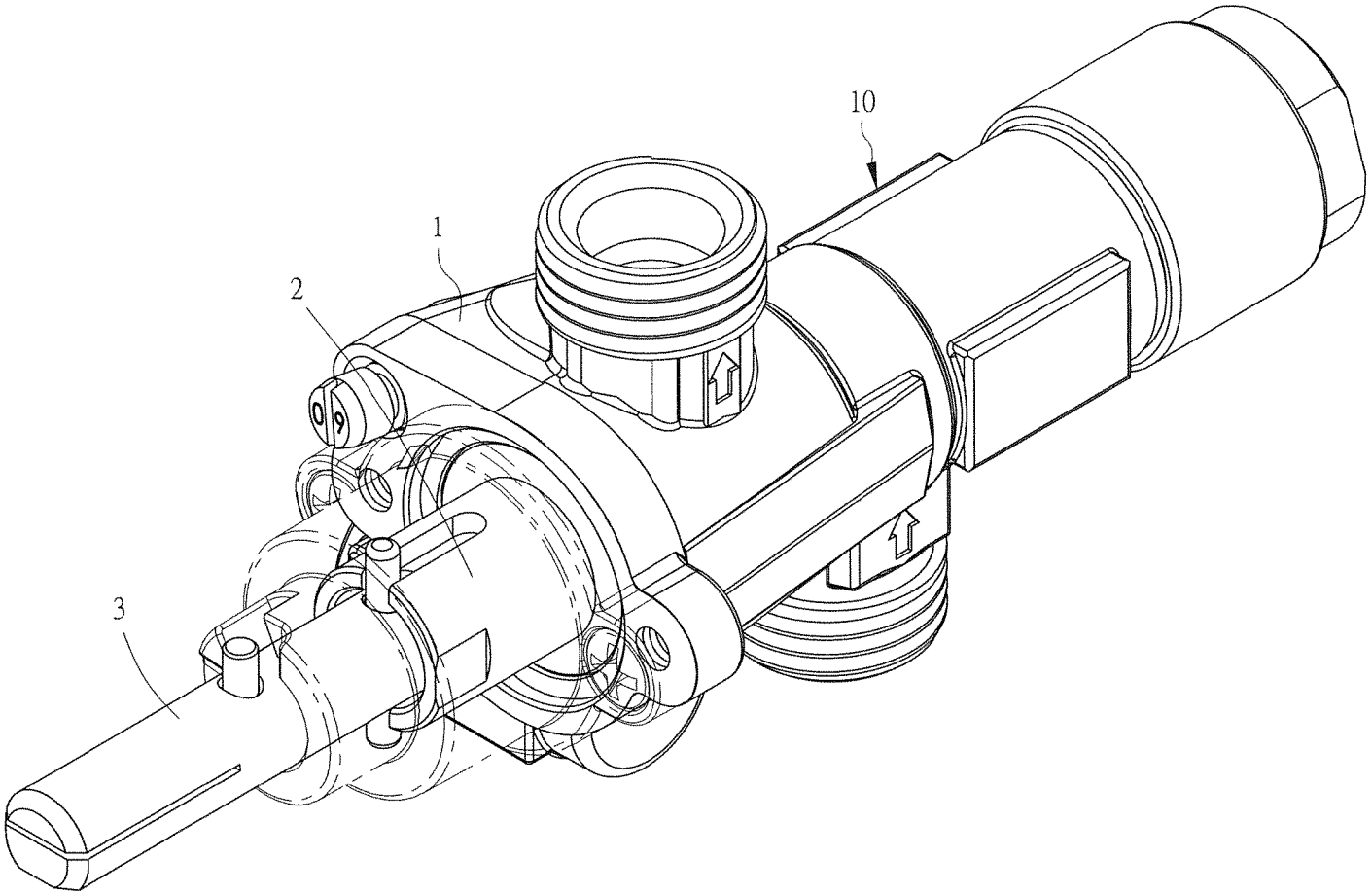
FIG. 2 is a perspective view of the gas control valve according to one embodiment of the present invention.

Please refer to FIG. 1 and FIG. 2, which, according to one embodiment of the present invention, show a schematic diagram of a gas ignition system and a perspective view of a gas control valve, respectively. The gas ignition system comprises a gas control valve (10), a main flame assembly (20), a pilot flame assembly (30) and an igniter (40). The gas control valve (10) has a valve base (1), a closing device (2), a control lever (3) and a magnetic control assembly (4). All the components will be described in detail below.

Figure 3:
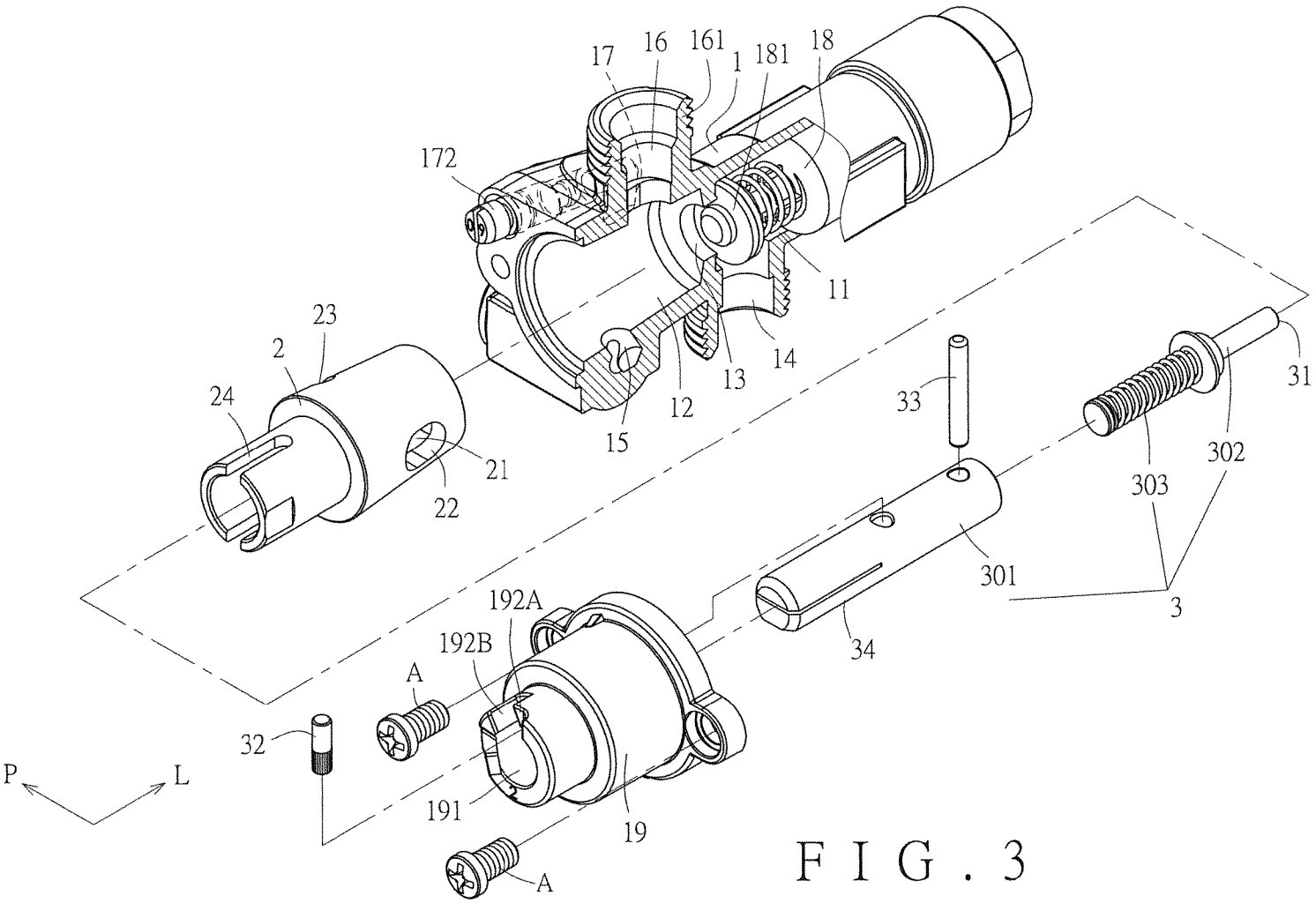
FIG. 3 is an exploded view of the gas control valve of FIG. 2.
Figure 4:
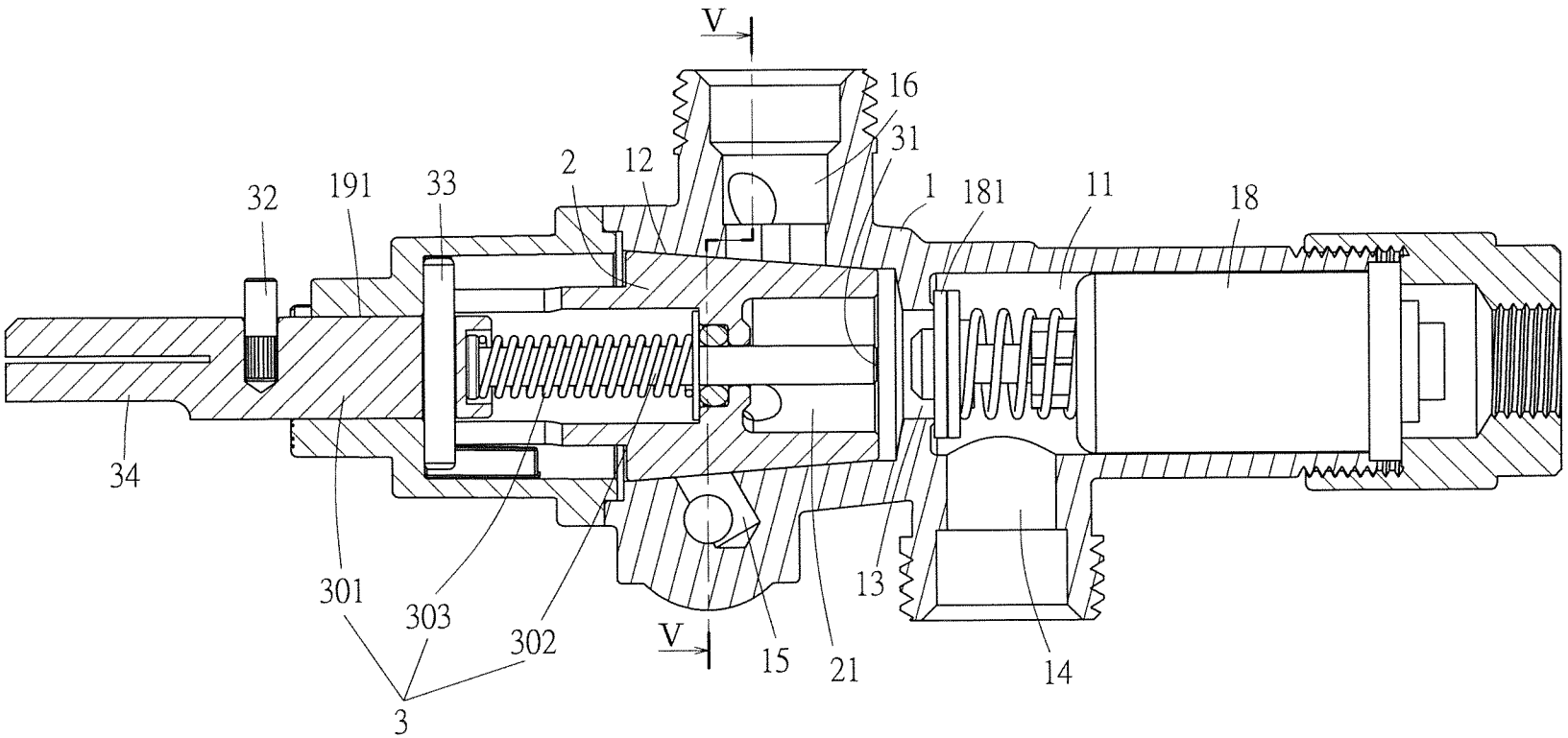
FIG. 4 is a cross-sectional view of the gas control valve of FIG. 2.

Further referring to FIG. 3 and FIG. 4, which are an exploded view and a cross-sectional view of the disclosed gas control valve, respectively. The valve base (1) has an inlet chamber (11), a circulation chamber (12), and a gate (13) that is communicated with the inlet chamber (11) and the circulation chamber (12). The valve base (1) has an inlet port (14), a pilot flame-supply hole (15), a first main flame-supply hole (16), and a second main flame-supply hole (17). The inlet port (14) is communicated with the inlet chamber (11), while the pilot flame-supply hole (15), the first main flame-supply hole (16) and the second main flame-supply hole (17) are all communicated with the circulation chamber (12). The valve base (1) has a solenoid valve (18) in the inlet chamber (11). The solenoid valve (18) has a plug (181) configured for closing the gate (13).

Figure 5:
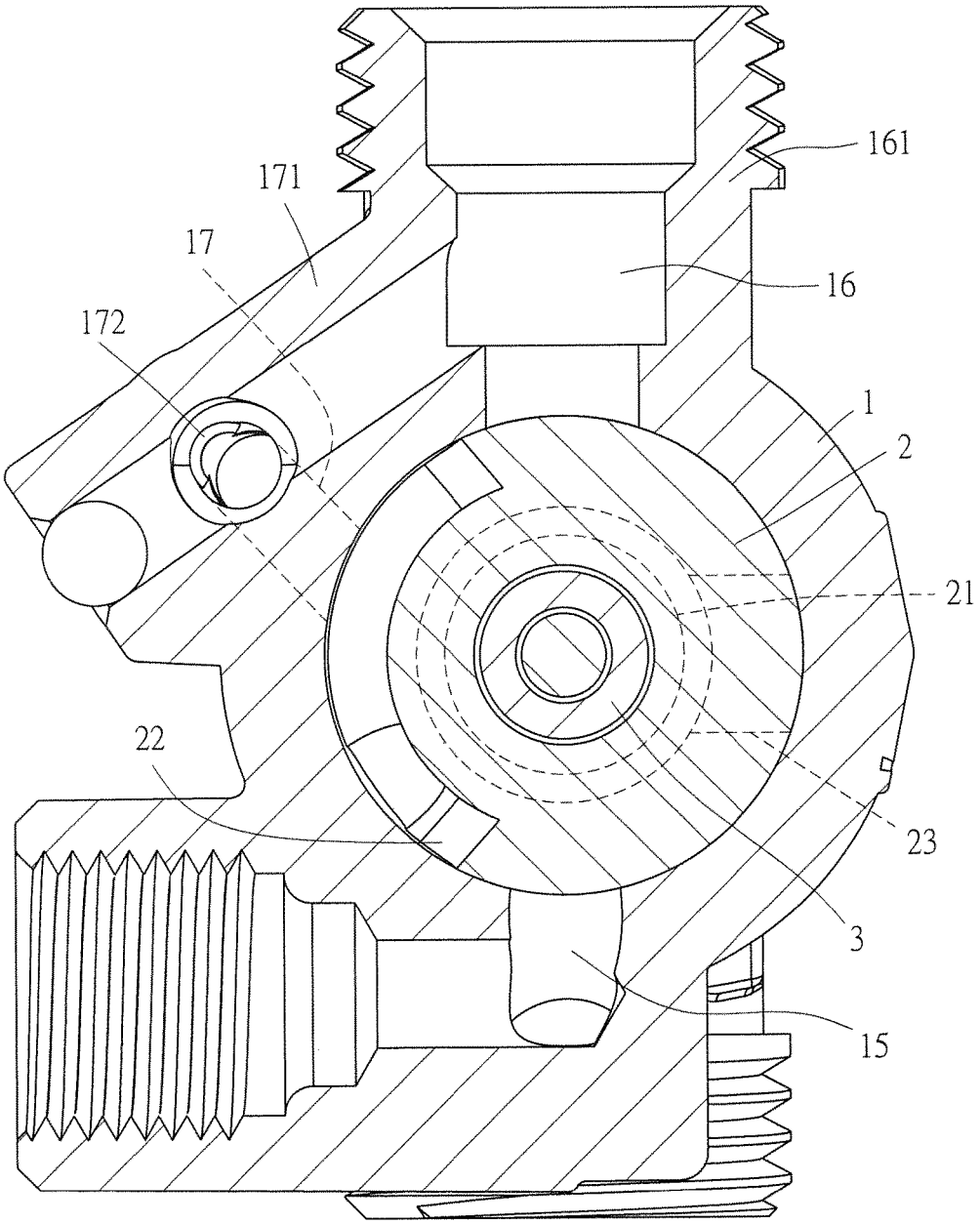
FIG. 5 is a cross-sectional view of the gas control valve taken along the line V-V of FIG. 4.

Please further refer to FIG. 5. Particularly, the valve base (1) has a first tube (161) extending from the first main flame-supply hole (16), and has a second tube (171) extending from the second main flame-supply hole (17). The second tube (171) is connected to the first tube (161). The second tube (171) has an adjuster (172) configured to adjust the gas flow running through the second tube (171).

The closing device (2) is configured to be installed in the circulation chamber (12) of the valve base (1). Also referring to FIG. 3A, the closing device (2) defines therein a channel (21) that is aligned with the gate (13) of the valve base (1). The closing device (2) has a pilot flame orifice (22) in the form of an annular slot and a main flame orifice (23). The pilot flame orifice (22) is communicated with the channel (21), and is configured to get aligned with the pilot flame-supply hole (15) of the valve base (1). The main flame orifice (23) is communicated with the channel (21), and is configured to, when rotating, get aligned with the first main flame-supply hole (16) and the second main flame-supply hole (17) of the valve base (1) successively. Additionally, the closing device (2) has a sliding slot (24).

The control lever (3) is movably connected to the valve base (1) and inserted through the channel (21) of the closing device (2). The control lever (3) has a propping portion (31) that is aligned with the plug (181) of the solenoid valve (18).

Particularly, the control lever (3) has a first limiting member (32) and a second limiting member (33). The control lever (3) comprises an operating shaft (301), an acting shaft (302) abutting against the operating shaft (301), and a spring member (303) mounted around the acting shaft (302). The first limiting member (32) and the second limiting member (33) are both attached to the operating shaft (301). The spring member (303) has its one end configured to be pressed against the valve base (1), so as to provide the control lever (3) with an axial returning resilience.

The valve base (1) has an axial direction (L) and a transverse direction (P) that is perpendicular to the axial direction (L). The valve base (1) has a valve bonnet (19) that is provided with an axial hole (191) extending in the axial direction (L). The valve bonnet (19) is fixed to the valve base (1) through a plurality of fixing members (A). The control lever (3) is rotatably received in the axial hole (191). The control lever (3) has an operating portion (34) that is formed on the operating shaft (301) and exposed outside the valve base (1).

Referring back to FIG. 1, the magnetic control assembly (4) has a magnetic control switch (41) and a magnetic member (42). The magnetic control switch (41) may be a Hall element or a magnetic reed switch. The magnetic control switch (41) is adjacent to the axial hole (191), and the magnetic member (42) is disposed on the operating portion (34).

It is to be noted that the arrangement of the magnetic control assembly (4) is not limited to what is described herein. The magnetic control switch (41) may be disposed on the operating portion (34) instead, while the magnetic member (42) is located adjacent to the axial hole (191). Alternatively, neither of the magnetic control switch (41) and the magnetic member (42) is disposed on the valve bonnet (19), provided that the movement of the control lever (3) allows the magnetic control switch (41) to form a closed circuit.

Preferably, the valve bonnet (19) of the valve base (1) has a first notch (192A) extending in the transverse direction (P) and a second notch (192B) connected to the first notch (192A) and extending in the axial direction (L).

Figure 3B:
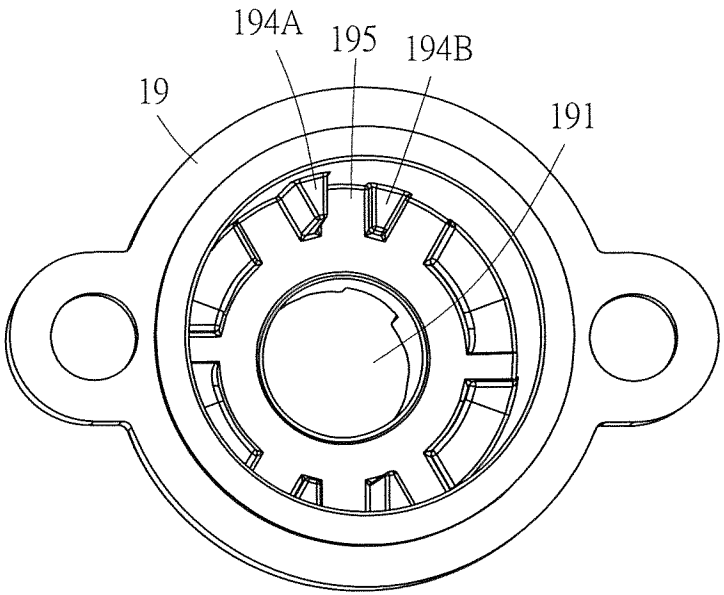
FIG. 3B is a perspective view of the bonnet of the gas control valve of FIG. 2 taken from another viewpoint.
Figure 3A:
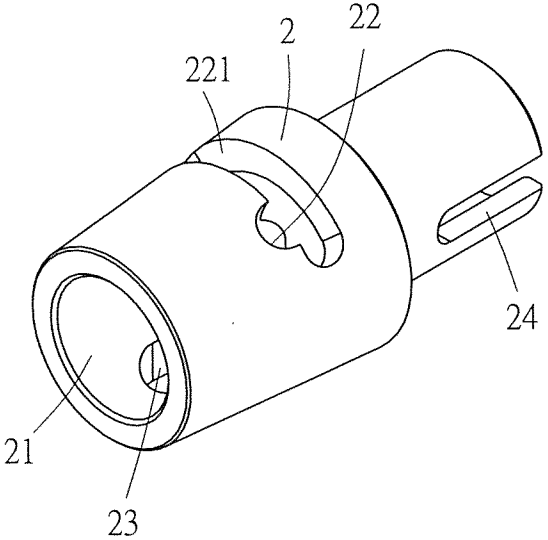
FIG. 3A is a perspective view of the closing device of the gas control valve of FIG. 2 taken from another viewpoint.

Also referring to FIG. 3B, the valve bonnet (19) of the valve base (1) has at least two stop blocks (194A) (194B) disposed on the hole wall of the axial hole (191). Between the two stop blocks (194A) (194B), there is an engaging recess (195) defined, which is configured to engage with the second limiting member (33) of the control lever (3).

Preferably, plural sets of the stop blocks (194A) (194B) are provided, so as to endow the control lever (3) with multi-step adjustment by positioning the control lever (3) between the stop blocks (194A) (194B) at individual steps. Therein, one said stop block (194A) extends more than the other (194B), so as to provide unidirectional stop when the second limiting member (33) of the control lever (3) leaves the engaging recess (195), thereby limiting the rotation of the control lever (3) to one direction and thus preventing users' misoperation.

The main flame assembly (20) is connected to the valve base (1) of the gas control valve (10) and has at least one main flame flue (21) that is communicated with both of the first main flame-supply hole (16) and the second main flame-supply hole (17) of the valve base (1).

The pilot flame assembly (30) is connected to the valve base (1) of the gas control valve (10), and has at least one pilot flame flue (301) that is communicated with the pilot flame-supply hole (15) of the valve base (1). Preferably, the pilot flame assembly (30) has a flame sensor that is connected to the solenoid valve (18) of the valve base (1), so that when the gas at the pilot flame assembly (30) is ignited, the flame sensor generates an ignition signal and sends it to the solenoid valve (18), thereby making the plug (181) of the solenoid valve (18) held at its open position where the plug is separated from the gate.

The igniter (40) is connected to the magnetic control switch (41) of the magnetic control assembly (4) through an ignition module (401), and is attached to the pilot flame assembly (30).

Figure 6:
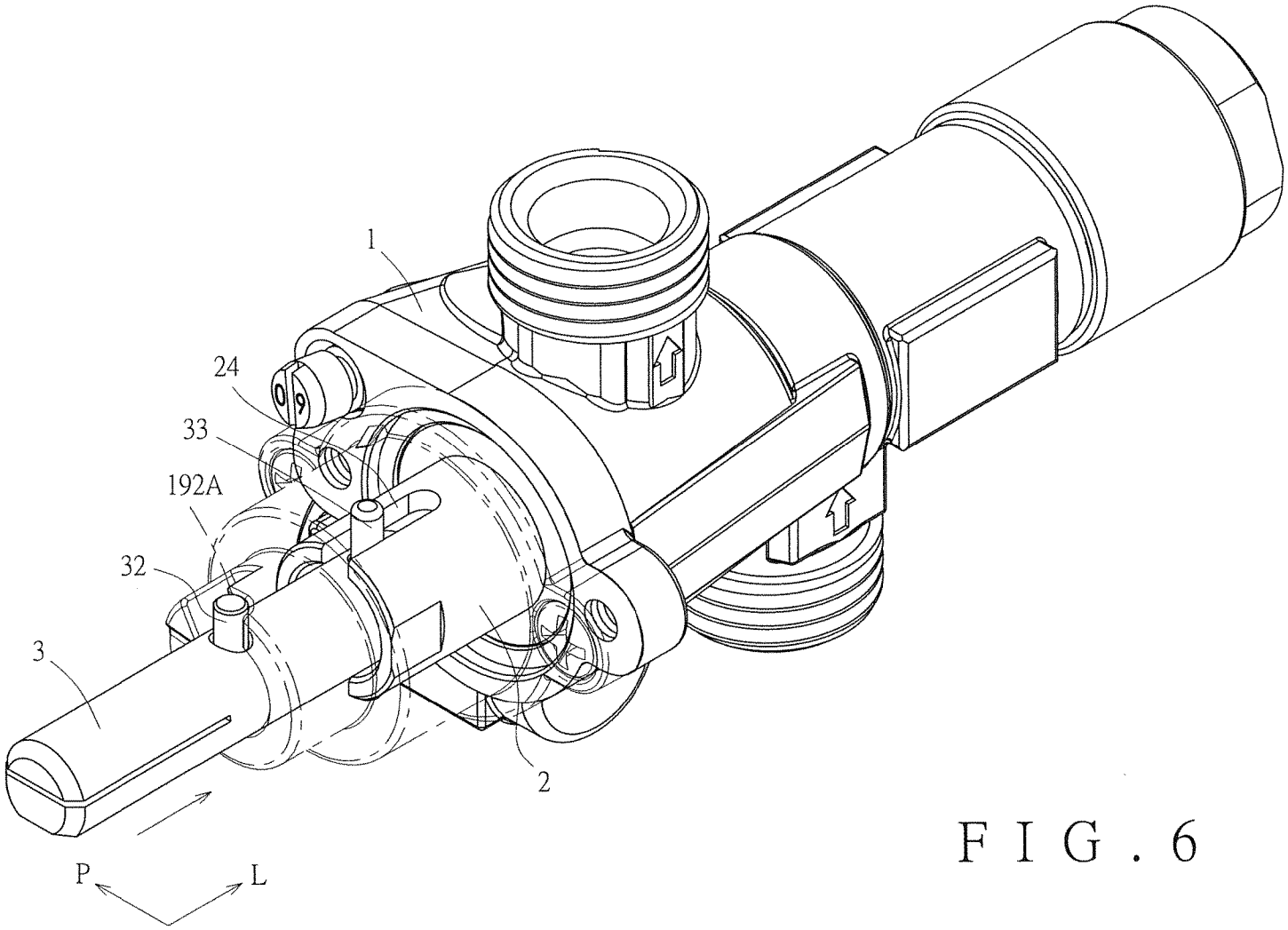
FIG. 6 is a schematic drawing illustrating how the control lever of the gas control valve is pushed inward the valve base.
Figure 7:
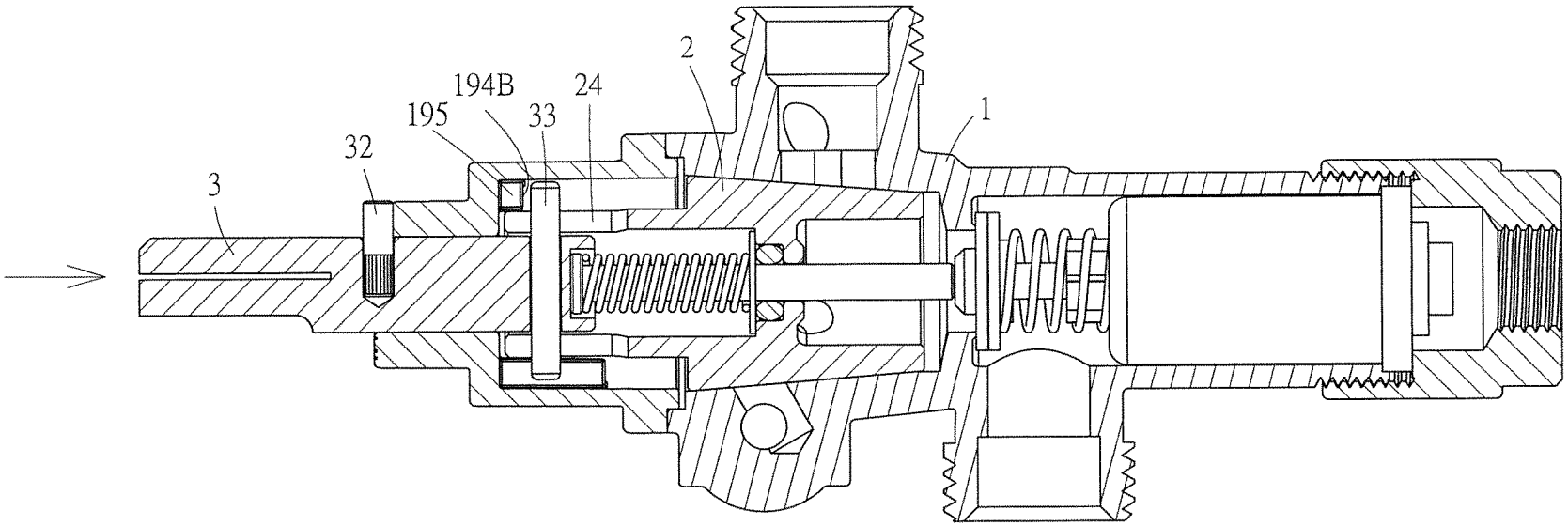
FIG. 7 is a cross-sectional view illustrating how the control lever of the gas control valve is pushed inward the valve base.

FIG. 6 and FIG. 7 illustrate how the device operates. In use, the control lever (3) is pushed inward the valve base (1) in the axial direction (L), so that the first limiting member (32) enters the first notch (192A), and the second limiting member (33) of the control lever (3) moves along the sliding slot (24) of the closing device (2). As a result, the second limiting member (33) escapes from the engaging recess (195), and the control lever (3) moves to a disengaged position.

Figure 8:
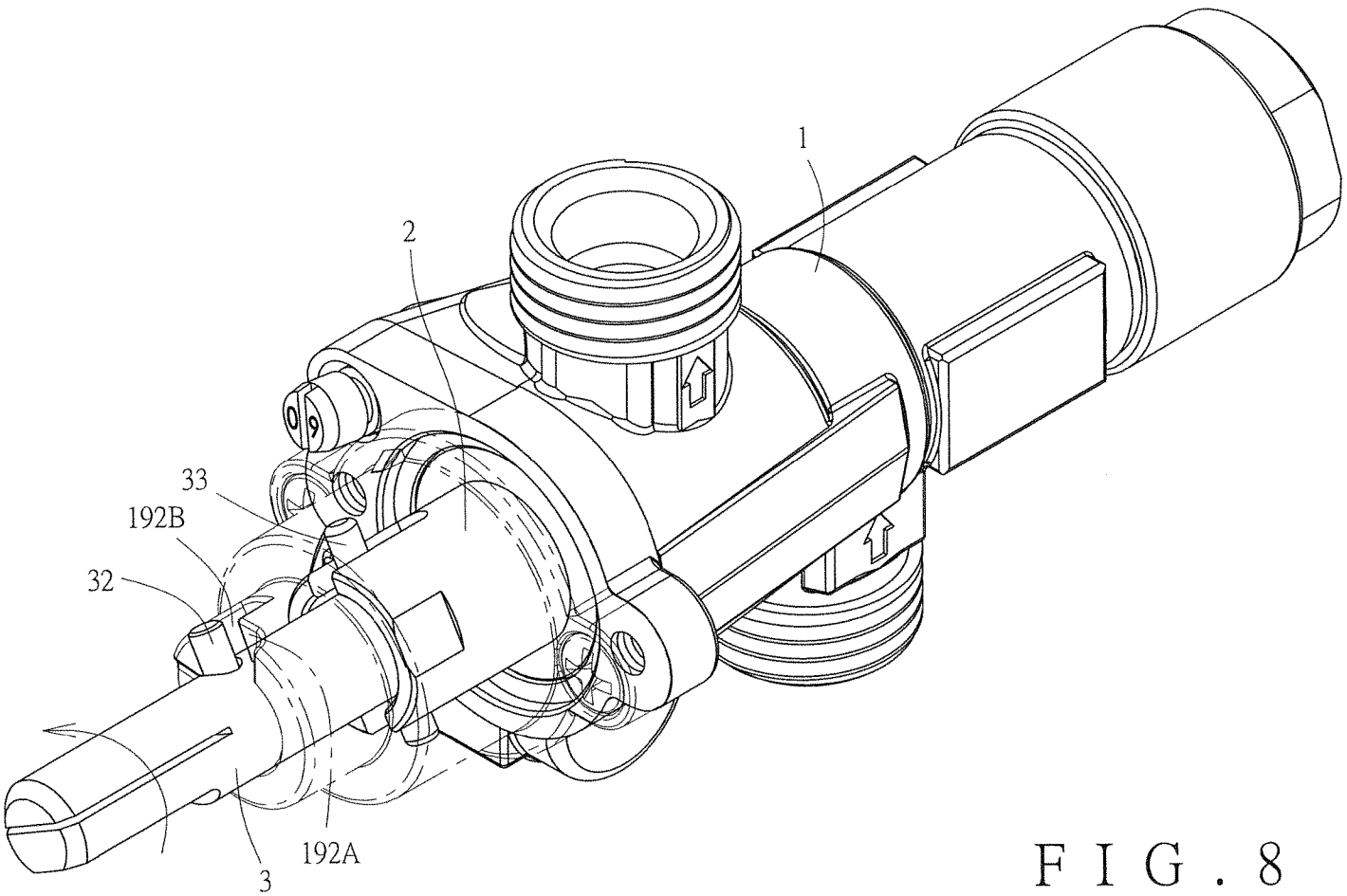
FIG. 8 is a schematic drawing illustrating how the control lever of the gas control valve is rotated.
Figure 9:
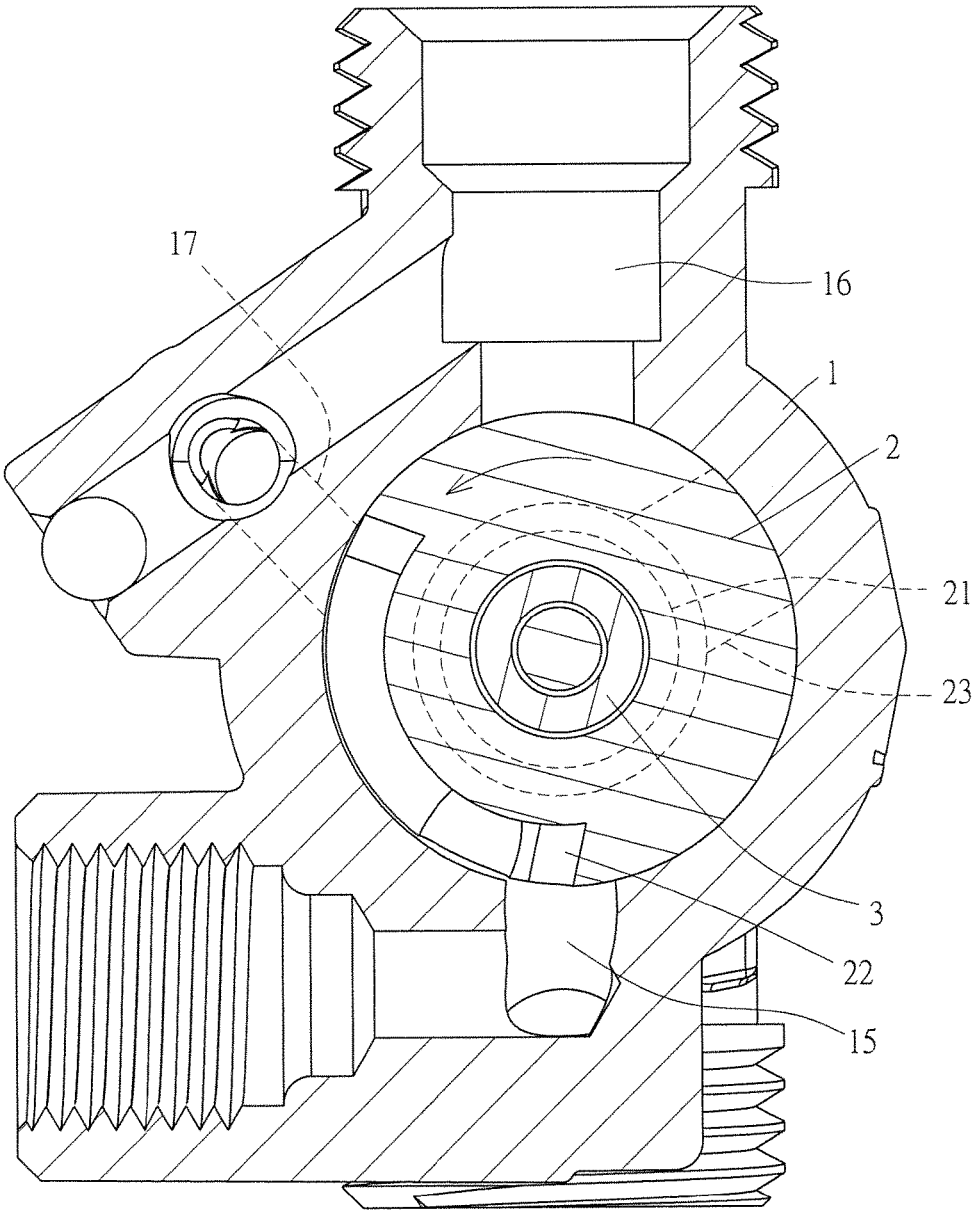
FIG. 9 is a schematic drawing illustrating how the control lever drives the closing device to rotate.

Referring to FIG. 8 and FIG. 9, then when the control lever (3) is rotated, the first limiting member (32) of the control lever (3) swings to the second notch (192B) of the valve base (1). At the same time, the control lever (3) drives the closing device (2) to move with its second limiting member (33), so that the pilot flame orifice (22) of the closing device (2) is aligned with the pilot flame-supply hole (15) of the valve base (1), while the main flame orifice (23) of the closing device (2) is aligned with neither the first main flame-supply hole (16) nor the second main flame-supply hole (17) yet.

Figure 10:
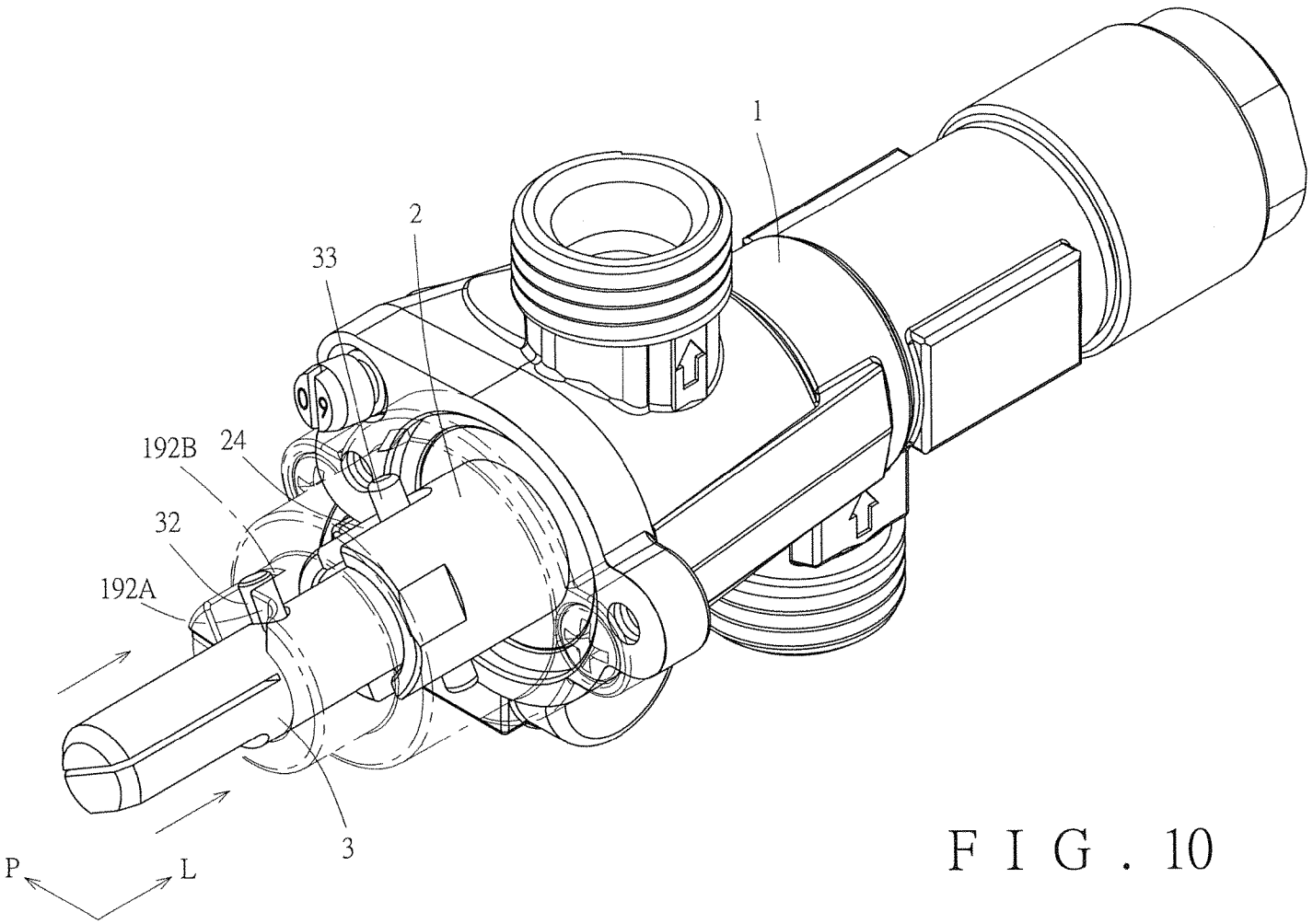
FIG. 10 is a schematic drawing depicting that the control lever is further pushed into the valve base.
Figure 11:
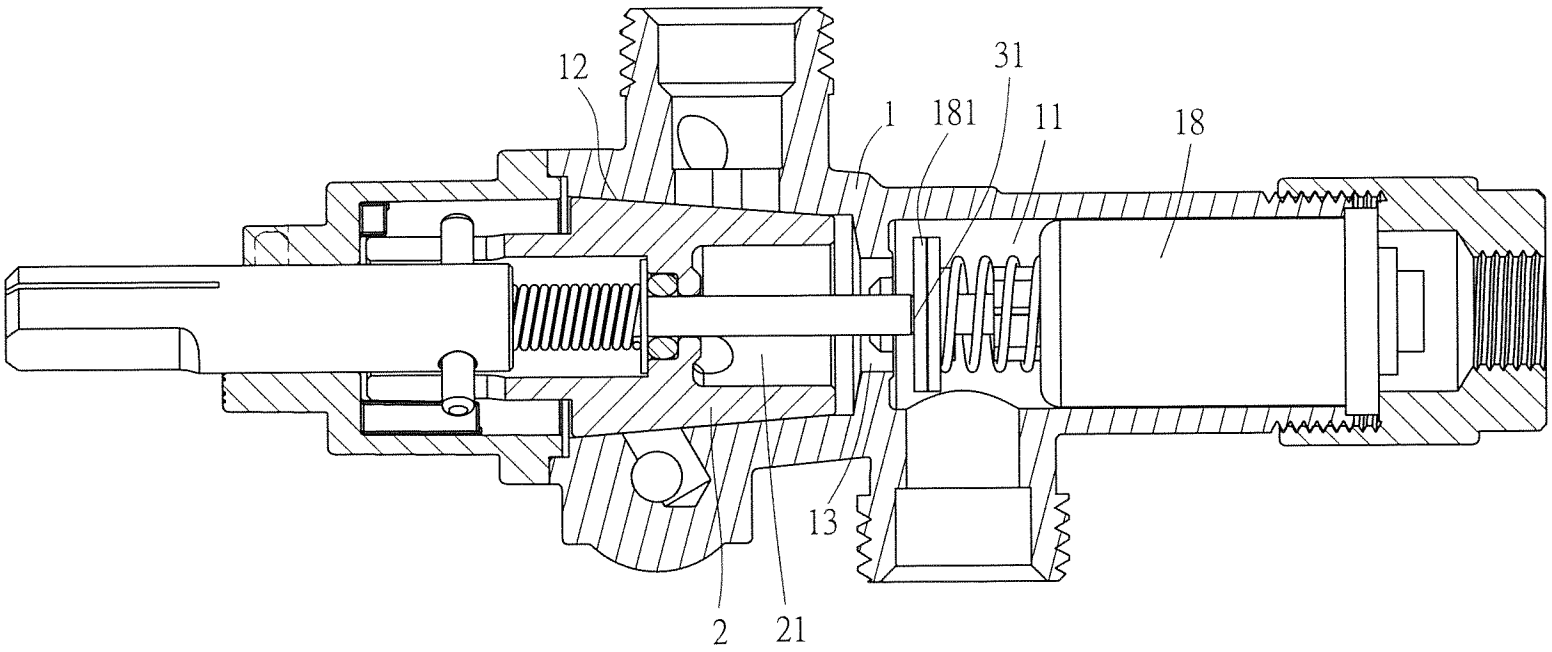
FIG. 11 is a cross-sectional view depicting that that the control lever is further pushed into the valve base and the plug of the solenoid valve is pushed away from the gate.
Figure 12:
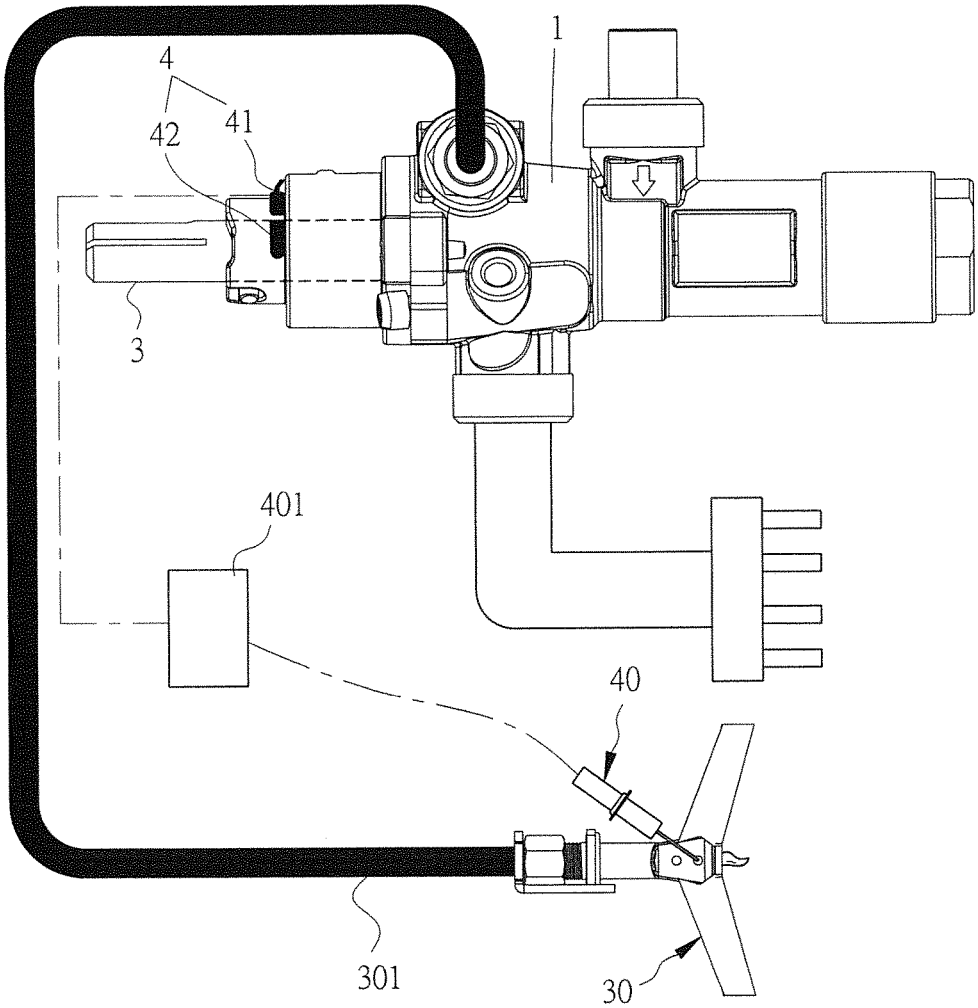
FIG. 12 is a schematic drawing depicting that the magnetic control switch is affected by the magnetic member and forms a closed circuit that activates the igniter to ignite gas at the pilot flame assembly.

Referring to FIG. 10 and FIG. 11, then when the control lever (3) is further pushed into the valve base (1) in the axial direction (L), the first limiting member (32) of the control lever (3) enters the second notch (192B), and the second limiting member (33) of the control lever (3) moves along the sliding slot (24) of the closing device (2), so the closing device (2) is not driven to move. As a result, the propping portion (31) of the control lever (3) pushes the plug (181) of the solenoid valve (18) away, so the plug (181) leaves the gate (13) of the valve base (1), thereby allowing the inlet chamber (11) of the valve base (1) to become communicated with the circulation chamber (12), which in turn allows the gas flows from the inlet chamber (11) into the channel (21) of the closing device (2). At this time, since the pilot flame orifice (22) of the closing device (2) is aligned with the pilot flame-supply hole (15) of the valve base (1) (referring back to FIG. 9), the gas is guided to the pilot flame flue (31) of the pilot flame assembly (30). Meanwhile, the magnetic member (42) installed on the control lever (3) moves to a site where it is aligned with the magnetic control switch (41) installed on the valve base (1) (as shown in FIG. 12), so that the magnetic control switch (41) forms a closed circuit and activates the ignition module (401) of the igniter (40), making the igniter (40) sparkle to ignite the gas at the pilot flame assembly (30). When the gas at the pilot flame assembly (30) is ignited and thereby a pilot flame is generated, the flame sensor sends the ignition signal to the solenoid valve (18), thereby making the plug (181) of the solenoid valve (18) stay at its open position, where the gas is allowed to be consciously guided into the circulation chamber (12) of the valve base (1). Otherwise, the plug (181) of the solenoid valve (18) returns to a close position, so as to prevent gas from keeping entering the pilot flame assembly (30) when the intended ignition fails.

Figure 13:
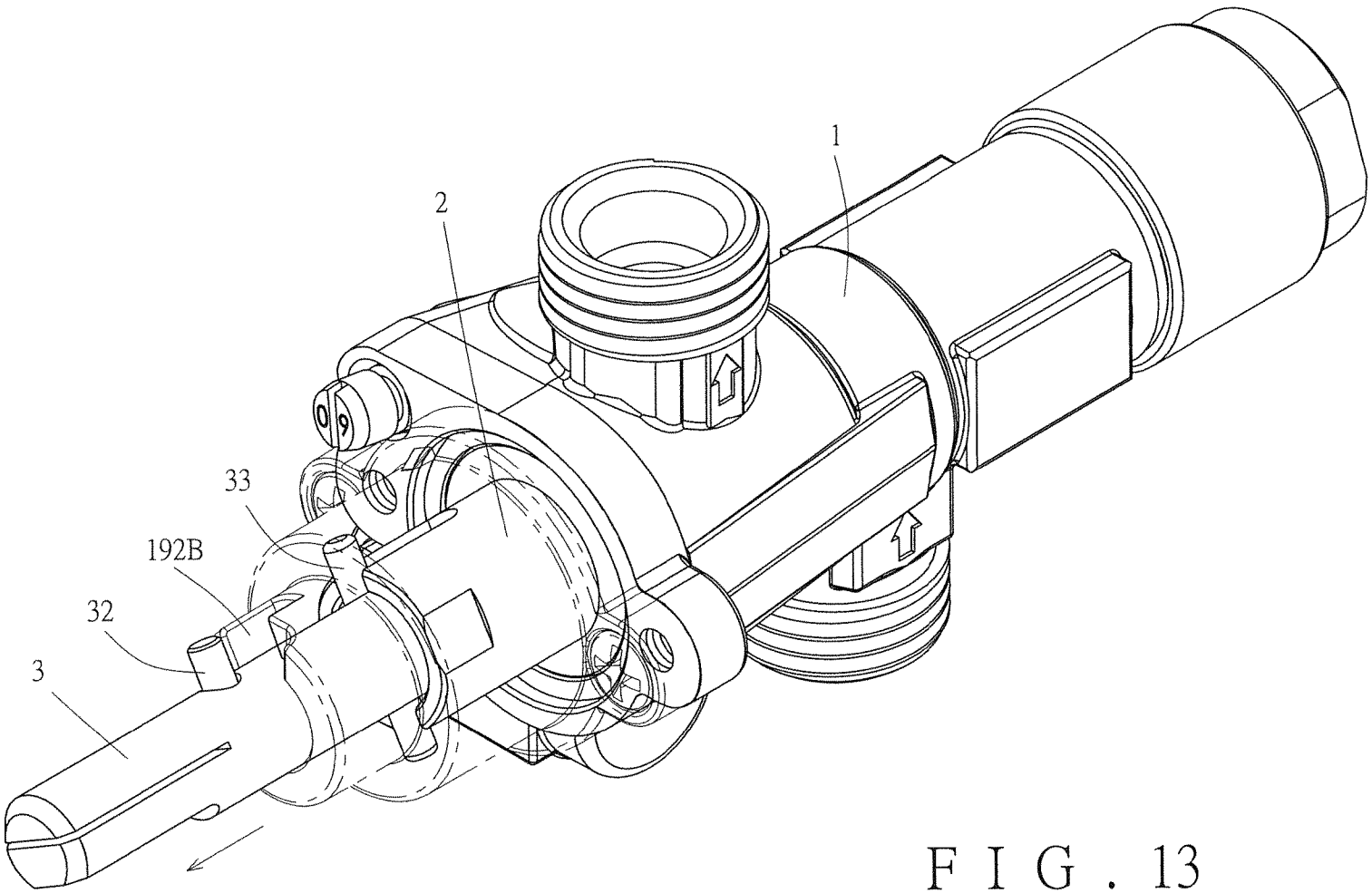
FIG. 13 is a schematic drawing depicting that the control lever is retracted right after the gas at the pilot flame assembly is ignited.
Figure 14:
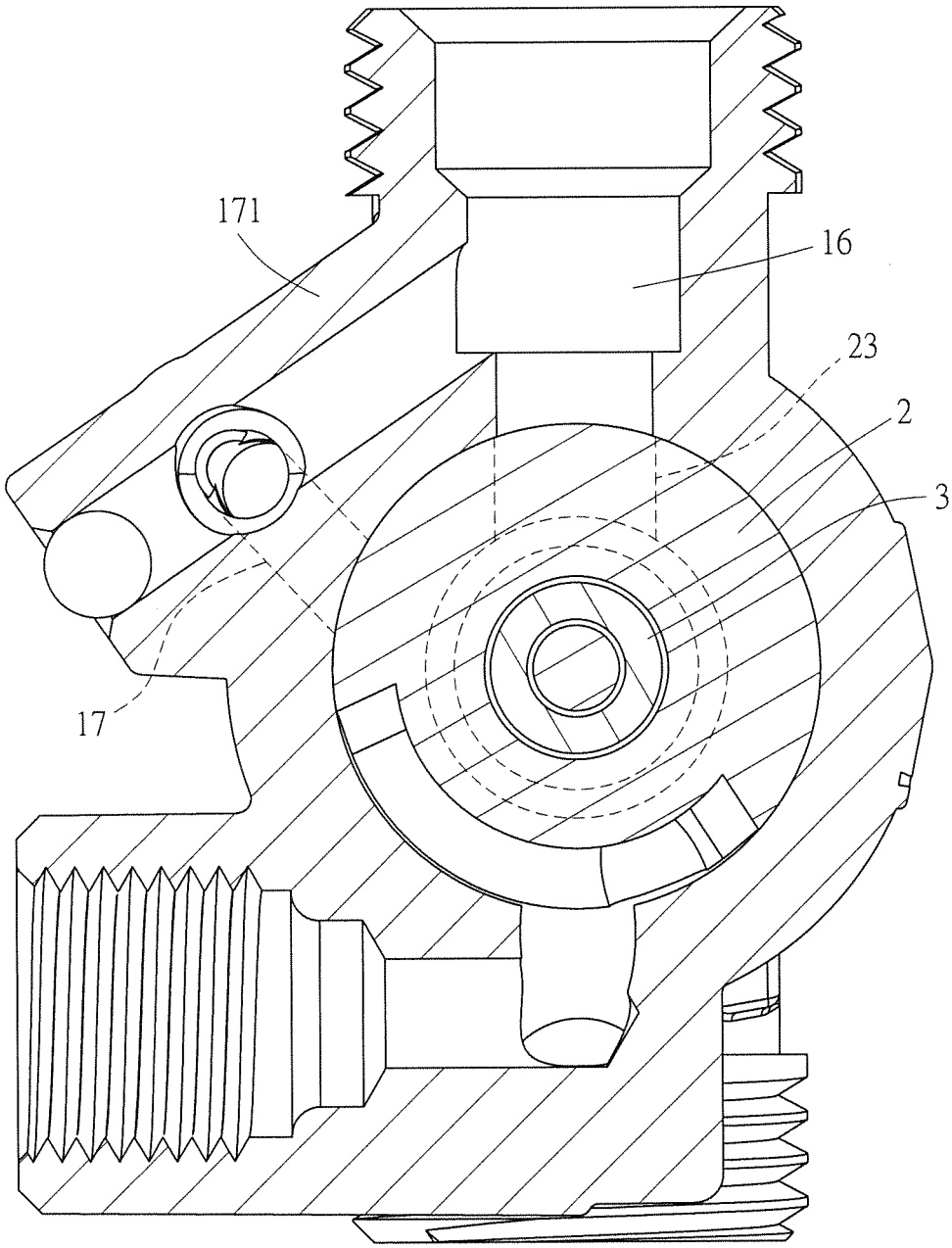
FIG. 14 is a schematic drawing depicting that the closing device serves to adjust the gas flow at the main flame assembly.

Now please refer to FIG. 13 and FIG. 14. Right after the gas at the pilot flame assembly (30) is ignited, the control lever (3) is retracted, so the first limiting member (32) of the control lever (3) exits from the second notch (192B). Then when the control lever (3) is such rotated that the main flame orifice (23) of the closing device (2) is aligned with the first main flame-supply hole (16) and the second main flame-supply hole (17), the gas is guided to the main flame flue (21) of the main flame assembly (20), so that the gas at the main flame assembly (20) is ignited by the pilot flame of the pilot flame assembly (30). At the same time, since the pilot flame orifice (22) of the closing device (2) is an annular slot, it keeps supplying the gas to the pilot flame assembly while the closing device (2) rotates, thereby keeping the pilot flame burning, and preventing the fire source at the main flame assembly (20) from accidentally going out.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A gas control valve featuring magnetic control, comprising:

a main body having a valve base and a control lever, the control lever being movably connected to the valve base, wherein the valve base has an axial hole extending in an axial direction for receiving the control lever, an operating portion of the control lever thereby exposed outside the valve base; and a magnetic control assembly having a magnetic member and a magnetic control switch, wherein the magnetic member is installed on one of the valve base and the control lever, while the magnetic control switch is installed on the other of the valve base and the control lever, the magnetic control switch being disposed adjacent the axial hole, and the magnetic member being disposed on the operating portion, wherein when the control lever moves to an ignition position, the magnetic control switch is affected by the magnetic member to form a closed circuit.

2. The gas control valve of claim 1, wherein the valve base has a first notch extending in a transverse direction that is perpendicular to the axial direction, wherein the valve base further has a second notch connected to the first notch and extending in the axial direction, and wherein the control lever has a first limiting member, wherein when the control lever moves in the axial direction, the first limiting member enters the first notch and is at a disengaged position, and when the control lever rotates, the first limiting member moves along the first notch to enter the second notch and moves to the ignition position along the second notch.

3. The gas control valve of claim 2, wherein the valve base has at least two stop blocks mounted on a hole wall of the axial hole, and an engaging recess is defined between the stop blocks, and wherein the control lever has a second limiting member configured to be received in the engaging recess when being at an engaged position, wherein when the control lever moves in the axial direction and the first limiting member enters the first notch, the second limiting member leaves the engaging recess, the control lever thereby being at the disengaged position.

4. The gas control valve of claim 3, wherein the valve base has therein an inlet chamber, a circulation chamber, and a gate that is communicated with the inlet chamber and the circulation chamber; wherein the valve base further has an inlet port and a pilot flame-supply hole, the inlet port being communicated with the inlet chamber, the pilot flame-supply hole being communicated with the circulation chamber; wherein the main body further includes a closing device configured to be received in the circulation chamber of the valve base, the closing device having a channel therein and a pilot flame orifice, the channel being aligned with the gate, communicated with the pilot flame orifice, and configured to receive the control lever, the pilot flame orifice corresponding to the pilot flame-supply hole; and wherein the closing device further has a sliding slot corresponding to the second limiting member of the control lever, wherein when the second limiting member moves along the sliding slot and escapes from the engaging recess, the control lever is at the disengaged position.

5. The gas control valve of claim 3, wherein one of the at least two stop blocks has a first extended length in the axial direction, and the other of the at least two stop blocks has a second extended length in the axial direction, wherein the second extended length is smaller than the first extended length.

6. The gas control valve of claim 1, wherein the valve base has therein an inlet chamber, a circulation chamber, and a gate that is communicated with the inlet chamber and the circulation chamber; wherein the valve base further has an inlet port and a pilot flame-supply hole, the inlet port being communicated with the inlet chamber, the pilot flame-supply hole being communicated with the circulation chamber; wherein the valve base also has a solenoid valve installed in the inlet chamber, the solenoid valve having a plug that is configured to removably close the gate; and wherein the control lever has a propping portion that is configured to prop the plug away from the gate so as to allow the inlet port to get communicated with the pilot flame-supply hole.

7. The gas control valve of claim 6, wherein the solenoid valve is such configured that when receiving a pilot flame ignition signal, the solenoid valve maintains the plug at an open position where the plug is separated from the gate.

8. The gas control valve of claim 6, wherein the main body further includes a closing device configured to be received in the circulation chamber of the valve base, the closing device having therein a channel aligned with the gate, wherein the closing device further has a pilot flame orifice communicated with the channel and corresponding to the pilot flame-supply hole, and wherein the control lever is inserted through the channel of the closing device.

9. The gas control valve of claim 8, wherein the valve base has a first main flame-supply hole, and wherein the closing device has a main flame orifice that is communicated with the channel, in which the main flame orifice is configured to be aligned with the first main flame-supply hole in response to rotation of the closing device.

10. The gas control valve of claim 9, wherein the valve base has a first tube extending from the first main flame-supply hole, and has a second main flame-supply hole configured to be aligned with the main flame orifice of the closing device, and wherein the valve base further has a second tube extending from the second main flame-supply hole and connected to the first tube, in which the second tube has an adjuster for adjusting a gas flow running through the second tube.

11. The gas control valve of claim 1, wherein the magnetic control switch is a Hall element.

12. A gas ignition system, comprising:

a gas control valve, having a main body and a magnetic control assembly, wherein the main body has a valve base, a closing device, and a control lever, wherein the valve base has therein an inlet chamber, a circulation chamber, and a gate that is communicated with the inlet chamber and the circulation chamber; wherein the valve base also has an inlet port, a pilot flame-supply hole and a main flame-supply hole, the inlet port being communicated with the inlet chamber, the pilot flame-supply hole and the main flame-supply hole both being communicated with the circulation chamber; and wherein the valve base has a solenoid valve installed in the inlet chamber, the solenoid valve having a plug configured to removably close the gate, so that when receiving a pilot flame ignition signal, the solenoid valve makes the plug stay at an open position where the plug is separated from the gate; wherein the closing device is installed in the circulation chamber of the valve base and has therein a channel aligned with the gate; wherein the closing device further has a pilot flame orifice and a main flame orifice, in which the pilot flame orifice is communicated with the channel and corresponds to the pilot flame-supply hole, while the main flame orifice is communicated with the channel and corresponds to the main flame-supply hole; and wherein the control lever is movably connected to the valve base and inserted through the channel of the closing device; wherein the control lever has a propping portion; and wherein the magnetic control assembly has a magnetic member and a magnetic control switch, the magnetic member being installed on one of the valve base and the control lever, the magnetic control switch being installed on the other of the valve base and the control lever;

a main flame assembly, connected to the valve base of the gas control valve and having at least one main flame flue that is communicated with the main flame-supply hole;

a pilot flame assembly, connected to the valve base of the gas control valve and having at least one pilot flame flue that is communicated with the pilot flame-supply hole; and an igniter, connected to the magnetic control switch of the magnetic control assembly and corresponding to the pilot flame assembly, wherein when the control lever moves to an ignition position, the propping portion of the control lever props the plug away from the gate, so that the inlet port becomes communicated with the pilot flame-supply hole, and the magnetic control switch is affected by the magnetic member to form a closed circuit that activate the igniter to sparkle.

13. A gas control valve featuring magnetic control, comprising:

a main body having a valve base and a control lever, wherein the control lever is movably connected to the valve base; and a magnetic control assembly having a magnetic member and a magnetic control switch, wherein the magnetic member is installed on one of the valve base and the control lever, while the magnetic control switch is installed on the other of the valve base and the control lever, wherein when the control lever moves to an ignition position, the magnetic control switch is affected by the magnetic member to form a closed circuit;

wherein the valve base has therein an inlet chamber, a circulation chamber, and a gate that is communicated with the inlet chamber and the circulation chamber; wherein the valve base has an inlet port and a pilot flame-supply hole, the inlet port communicating with the inlet chamber, the pilot flame-supply hole communicating with the circulation chamber; wherein the valve base has a solenoid valve installed in the inlet chamber, the solenoid valve having a plug configured to removably close the gate; and wherein the control lever has a propping portion configured to prop the plug away from the gate to allow the inlet port to communicate with the pilot flame-supply hole.

14. The gas control valve of claim 13, wherein the solenoid valve is such configured that when receiving a pilot flame ignition signal, the solenoid valve maintains the plug at an open position where the plug is separated from the gate.

15. The gas control valve of claim 13, wherein the main body further includes a closing device that is configured to be received in the circulation chamber of the valve base, the closing device having therein a channel that is aligned with the gate, wherein the closing device further has a pilot flame orifice communicated with the channel and corresponding to the pilot flame-supply hole, and wherein the control lever is inserted through the channel of the closing device.

16. The gas control valve of claim 15, wherein the valve base has a first main flame-supply hole, and wherein the closing device has a main flame orifice that is communicated with the channel, in which the main flame orifice is configured to be aligned with the first main flame-supply hole in response to rotation of the closing device.

17. The gas control valve of claim 16, wherein the valve base has a first tube extending from the first main flame-supply hole, and has a second main flame-supply hole configured to be aligned with the main flame orifice of the closing device, and wherein the valve base further has a second tube extending from the second main flame-supply hole and connected to the first tube, in which the second tube has an adjuster for adjusting a gas flow running through the second tube.

* * * * *